US006672516B1

(12) United States Patent
Skoutelas

(10) Patent No.: US 6,672,516 B1
(45) Date of Patent: Jan. 6, 2004

(54) THICK WEB MITER RAIL JOINT SYSTEM BETWEEN STATIONARY AND VERTICALLY MOVABLE TRACK SECTIONS

(75) Inventor: Nicholas J. Skoutelas, Chadds Ford, PA (US)

(73) Assignee: National Railroad Passenger Corporation, Washington, DC (US)

( * ) Notice: Subject to any disclaimer, the term of this patent is extended or adjusted under 35 U.S.C. 154(b) by 0 days.

(21) Appl. No.: 09/764,429

(22) Filed: Jan. 19, 2001

(51) Int. Cl.[7] ..... E01B 11/00

(52) U.S. Cl. ..... 238/174; 238/151; 238/235; 238/121; 238/122

(58) Field of Search ..... 238/122, 121, 238/125, 151, 167, 172, 173, 174, 175, 235

(56) References Cited

U.S. PATENT DOCUMENTS 476,165 A * 5/1892 O'Shea ..... 222/482
988,542 A * 4/1911 Bohannan ..... 238/174
6,000,624 A * 12/1999 Marron ..... 238/174
6,068,196 A * 5/2000 Benenowski et al. ..... 238/171

* cited by examiner

*Primary Examiner*—Mark T. Le
(74) *Attorney, Agent, or Firm*—Lowe Hauptman Gilman & Berner LLP

(57) ABSTRACT

A miter rail system for spanning a railroad track joint includes a fixed rail and a lift rail formed from thick web rail stock. The joining ends of the fixed and lift rails are notched to interfit with each other along a predetermined longitudinal extent along the notches so that at least gage sides of the associated fixed and lift rails are in alignment with each other to provide a generally smooth and uninterrupted surface for rolling stock wheels. Preferentially, the inward facing edge of the notch is substantially entirely coextensive with a side of the thick web as a result of milling out, once the ends of the rails adapted to face each other have been bent.

10 Claims, 9 Drawing Sheets

THICK WEB MITER RAIL JOINT SYSTEM BETWEEN STATIONARY AND VERTICALLY MOVABLE TRACK SECTIONS

TECHNICAL FIELD

The present invention relates generally to miter rail track joints and, more particularly, to miter rail track joints between stationary and vertically movable track sections for use on bridges.

BACKGROUND ART

Railroad bridges are commonly used to span waterways used by commercial, military and pleasure vessels having equipment or super structures extending a sufficient height above the elevation of the railroad bridge deck such as to make passage impossible unless the deck is moved out of the vessel's path. In light of this, there are different kinds of railroad bridges that have movable decks to permit uninterrupted passage of such vessels or boats as necessary. The bridge decks are designed to be in an operating position that enables the passage of rolling stock wheels over the bridge and an inoperative position in which the deck is moved in relation to the stationary approach track section in order to permit the vessel or boat to move through the bridge as a result of physically displacing the movable deck out of the vessel path. The most common types of movable railroad bridge decks are the swing bridge, the vertical lift bridge and the bascule bridge. The present invention has applicability to all of these different bridge types. However, for purposes of this description, the invention will be described with reference to a swing bridge only.

A swing bridge has a deck that is generally supported on a turntable that rotates approximately 90° about a vertical axis of rotation and in a substantially horizontal plane between the train passage and vessel or boat passage positions. A vertical lift bridge has a pair of towers on opposite ends of the bridge deck. Machinery is used to raise and lower the deck while maintaining the deck in a substantially horizontal orientation. Finally, a bascule bridge has a bridge deck that is pivotally connected to a bridge approach, pier, etc., about a horizontal pivot axis that enables the deck to swing upwardly and downwardly.

Miter rails are commonly used as transition points to bridge the gap between adjacent ends of a section of vertically movable track (commonly referred to as "lift rails") and a section of stationary track (commonly known as "approach rails"). In prior art FIG. 1, by way of example, there is disclosed a miter rail joint 10 located between a stationary track section 12 (approach track) and a movable track section 14 (e.g. located on a swing span of a swing bridge). In this conventional system, the approach left and right-handed rails 12*a* and 12*b* are made of conventional rolling stock steel rail (these are fixed running rails) that are conventionally fastened to rail ties (not shown) using appropriate rail plates 16 and rail clips all supported by a fixed structure 18 such as a stationary structure in the form of a roadway, bridge pier, or other fixed railway support structure. The movable rail section 14 are left and right lift rails 14*a*,14*b* that are also formed from conventional rolling stock fastened with rail plates, rail ties, rail clips, etc., to a movable structure 20 that may be a deck of a vertical lift bridge or a bascule bridge, or a turntable of a swing bridge.

In the conventional design, the miter rail joint 10 is formed from a pair of solid manganese rails 12*a*,14*a* and 12*b*,14*b* that are respectively spot welded to joining ends of the conventional steel rail stock 22 at points 24 remote from the miter rail joint. These solid manganese rails 12*a*,14*a* and 12*b*,14*b* have a rectangular cross-section as best depicted in FIG. 3 and the facing ends of the respective approach and lift manganese rails 12*a* are respectively notched at 26 and 28 and milled (as shown in FIGS. 2 and 4) so that the upper longitudinally extending parallel edges 30*a* and 30*b* along the field and gage sides of the respective fixed and lift rails are in respective alignment with each other to provide a smooth travel surface across the miter joint 10 for rolling wheel stock.

The use of manganese rails 12*a*,12*b* and 14*a*,14*b* requires that the remote ends of the fixed and lift manganese rail sections be butt welded (e.g. at 24) to ensure proper connection to the steel rail stock 22.

Other types of miter rail systems for use in bridge crossings are known in which, for example, a separate rider rail is bolted to the outer side of a stationary running rail of the miter rail system that supposedly minimizes chipping damages that are believed to be caused by the upper end edges or corners of rider rails of other miter rail systems as known in the prior art. However, the use of such rider rails necessitates additional components in the area of the miter rail joint which in turn necessitates the assembly and installation of additional rail items that must be both maintained and repaired.

A need, therefore, exists for a miter rail system of a simplified design that is capable of reliable use in rugged environments.

SUMMARY OF THE INVENTION

A miter rail system, in accordance with the present invention, comprises a fixed running rail and a lift running rail each made of a thick web material having a crown or head, a base, and a web extending between the base and crown. Each running rail and fixed rail has facing ends that are each milled out to form a notch extending through the associated crown and base that enable the fixed and running rail ends to interfit with each other along the extent of the notches so at least gage sides of the respective rails are in alignment with each other to provide a generally smooth and uninterrupted surface for rolling stock wheels.

By forming the web from a thick web material, typically in the range of 1¼–1¾ inch, whereas conventional web thicknesses of rail steel stock are about ¾ inch, a sufficient amount of web material remains at the joint, coextensive with the notch, to support the remaining portions of the crown supporting the rolling stock wheels during use.

Preferably, the ends of the rails that ultimately oppose each other to form the miter rail joint are formed by bending one end of the associated rail over a predetermined length and then milling the notch in the bent end to form the notch along an inward facing surface that is preferably coextensive with a side of the web facing the notch. The opposite side of the crown and face are also milled to remove the bent portion and enable the side of the crown facing away from the notch to be coextensive with unbent rail portions immediately adjacent thereto.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
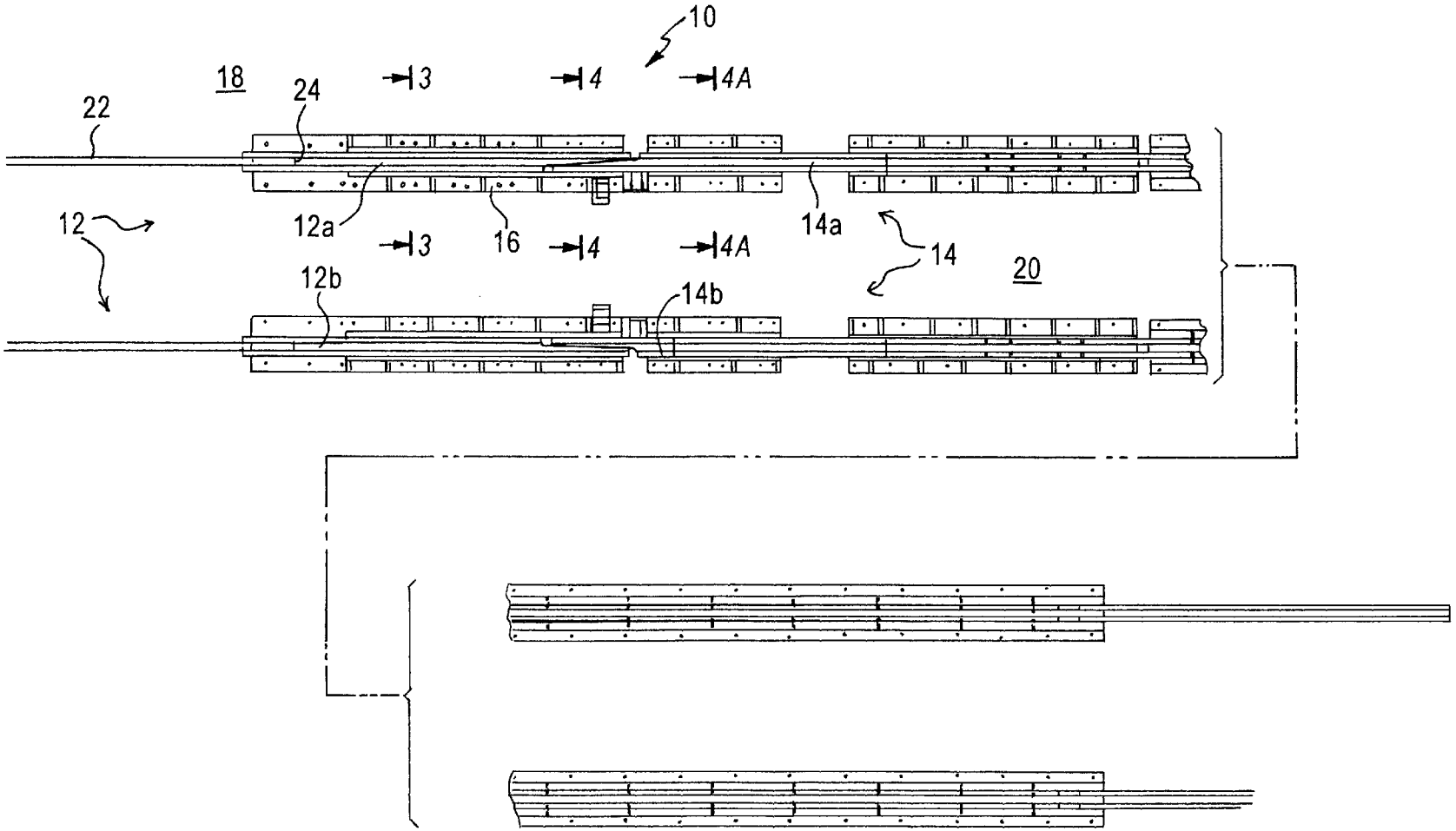
FIG. 1 (PRIOR ART)
FIG. 1 is a top plan view scaled representation of a railway track joint installation employing a conventional miter rail system as known in the prior art.
Figure 2:
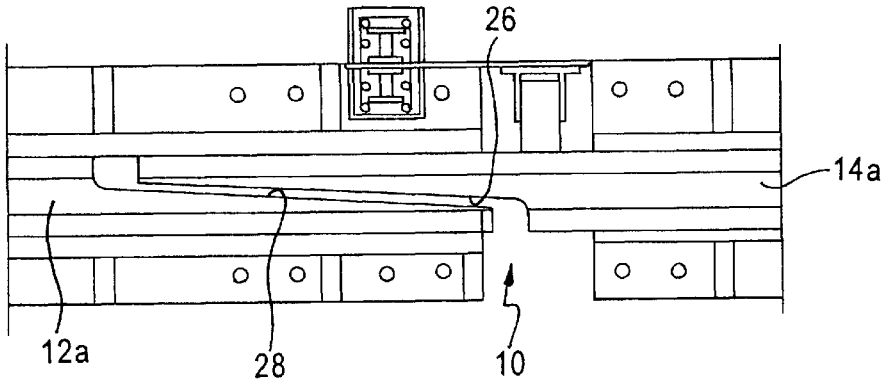
FIG. 2 (PRIOR ART)
FIG. 2 is an enlarged top plan view scaled representation of the conventional miter rail system of FIG. 1.
Figure 3:
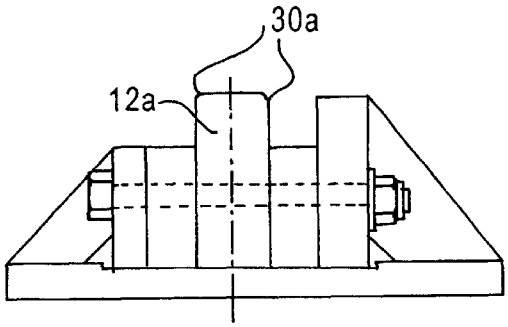
FIG. 3 (PRIOR ART)
FIG. 3 is a sectional scaled view taken along the line 3—3 of FIG. 1 to illustrate the rectangular cross-section of the manganese approach or lift rail of the conventional design.
Figure 4:
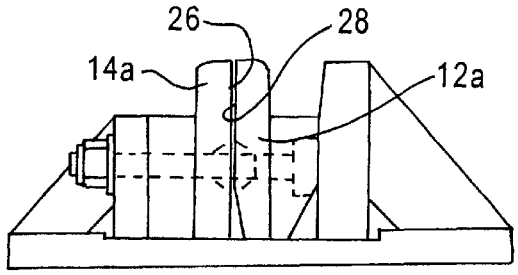
FIG. 4 (PRIOR ART)
FIG. 4 is a sectional view scaled representation taken along the line 4—4 of FIG. 1 depicting the cross-sectional shape of the milled solid manganese rail along the point of the miter rail joint.
Figure 4A:
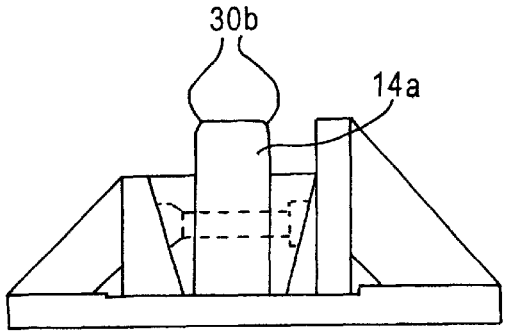
FIG. 4A (PRIOR ART)
FIG. 4A is taken along the line 4A—4A of FIG. 1.
Figure 5:
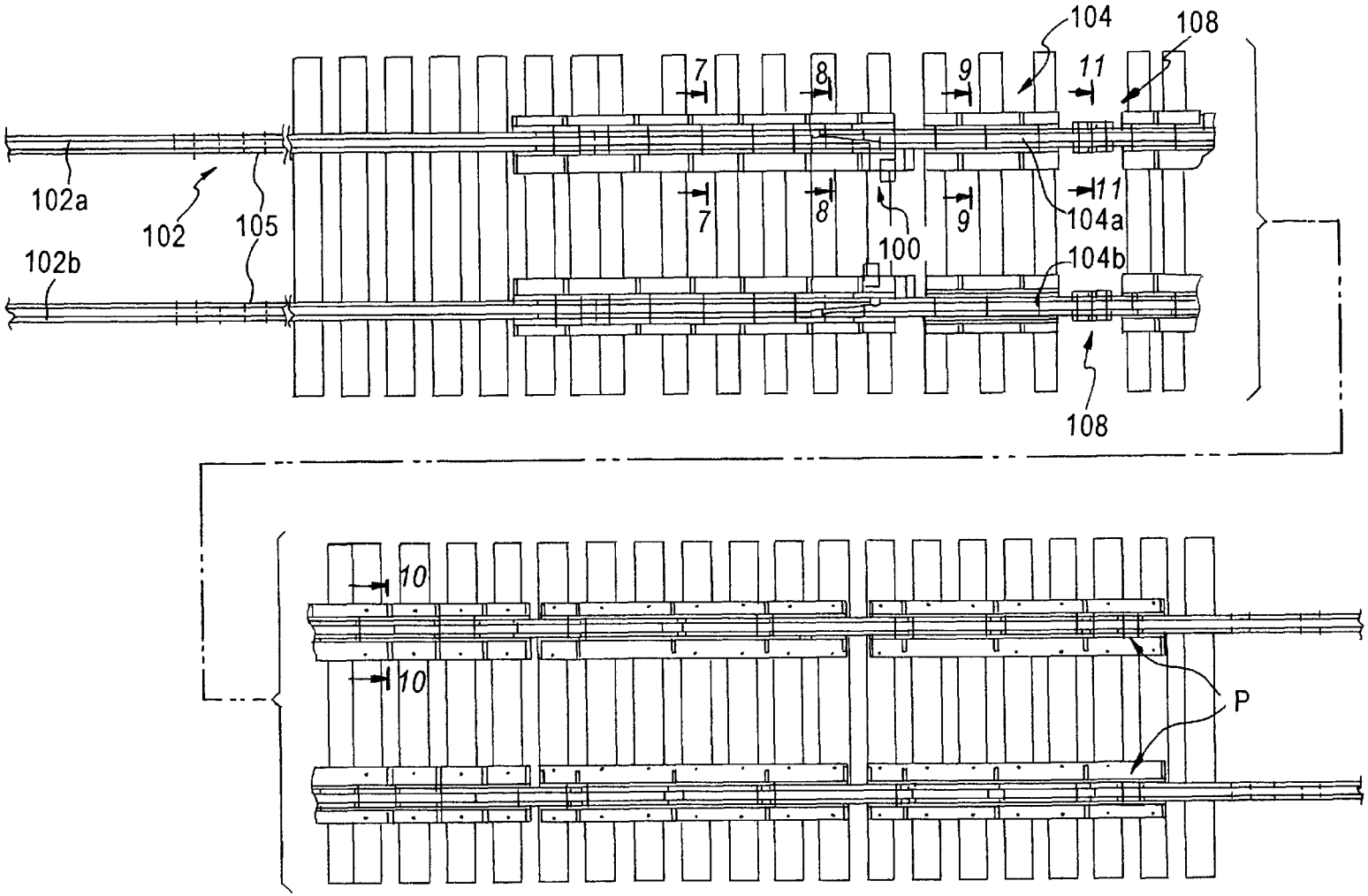
FIG. 5 is a top plan view scaled representation of a railway track joint installation utilizing a thick web miter rail system according to the present invention.
Figure 6:
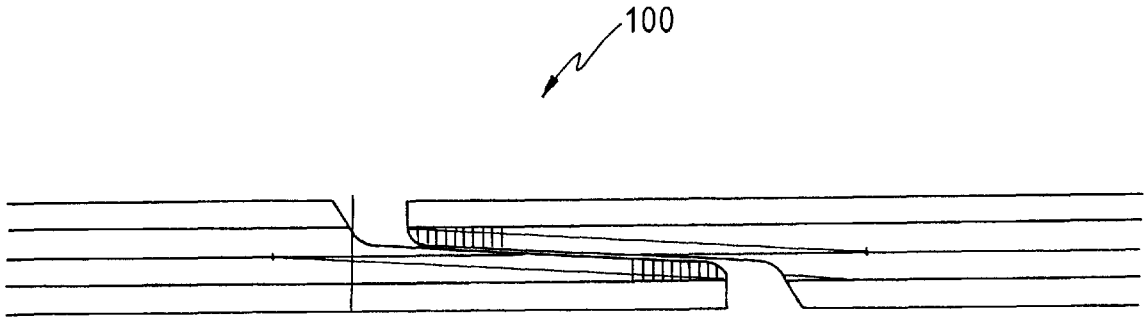
FIG. 6 is an enlarged top plan scaled representational view of the miter rail point of FIG. 5.
Figure 11:
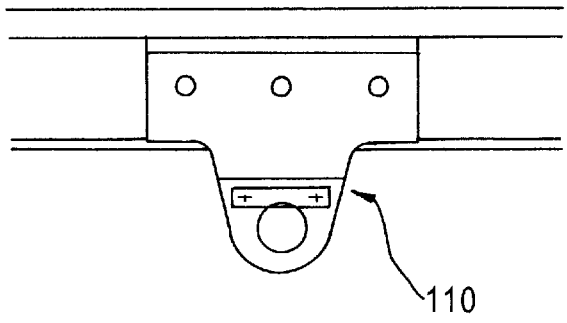
FIG. 11 is a sectional view scaled representation taken along the line 11—11 of FIG. 5 to depict the lift brackets in cross-sectional and side profile.

FIG. 5 is a scaled illustration of a miter rail system according to the present invention generally identified with reference numeral 100, that is used to bridge a railway track joint between stationary and vertically movable track sections 102 and 104, respectively. The system 100 utilizes a thick web steel rail T to form left and right fixed or approach running rails 102*a* and 102*b* as well as lift or swing rail sections 104*a*,104*b* in which facing ends of associated pairs of the lift and running rails 102*a*,104*a* and 102*b*,104*b* are notched and thereby interfitted with each other along the extent of the notches so that at least gage sides (generally identified with numeral 105) of the respective fixed and lifting rails are in alignment with each other to provide a generally smooth, load-bearing, uninterrupted surface for rolling stock wheels. The lift or swinging rails 104*a*,104*b* can be raised by application of a force at 108 from a lifting device (not shown but conventional) applied to a lift bracket 110 (FIG. 11) located between the notched end of each rail 104*a*,104*b* and a pivot point P defining a horizontal pivot axis (perpendicular to the rail) about which the notched lift rail at 100 is lifted clear from the corresponding notched end of the fixed rail to thereby enable the lift rail to be swung or pivoted out of the way of approaching boat or vessel traffic. The feature of utilizing thick web rail stock T advantageously ensures that sufficient material is located beneath the remaining portions of the notched rail end to provide sufficient structural support that receives and supports rolling wheel stock traversing the miter rail points 100 in a safe and reliable operation.

Figure 8:
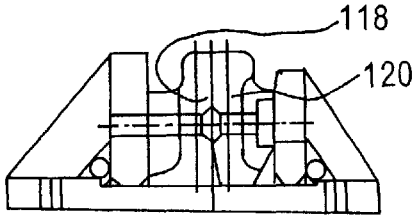
FIG. 8 is a sectional view scaled representation taken along the line 8–8 of FIG. 5 to depict the milled cross-sectional profile of the thick web rails in the area of overlapping or side-by-side positioning proximate the miter rail point.
Figure 9:
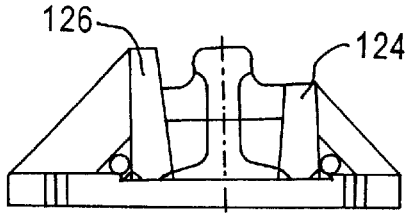
FIG. 9 is a sectional view scaled representation taken along the line 9—9 of FIG. 5 in a manner similar to FIG. 7 to depict the identical cross-section of the thick web rail used in the lift rail section.
Figure 10:
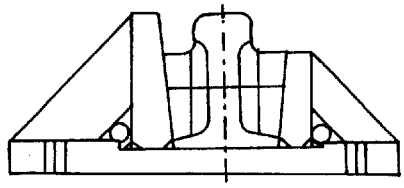
FIG. 10 is a sectional view scaled representation taken along the line 10—10 of FIG. 5.
Figure 12A:
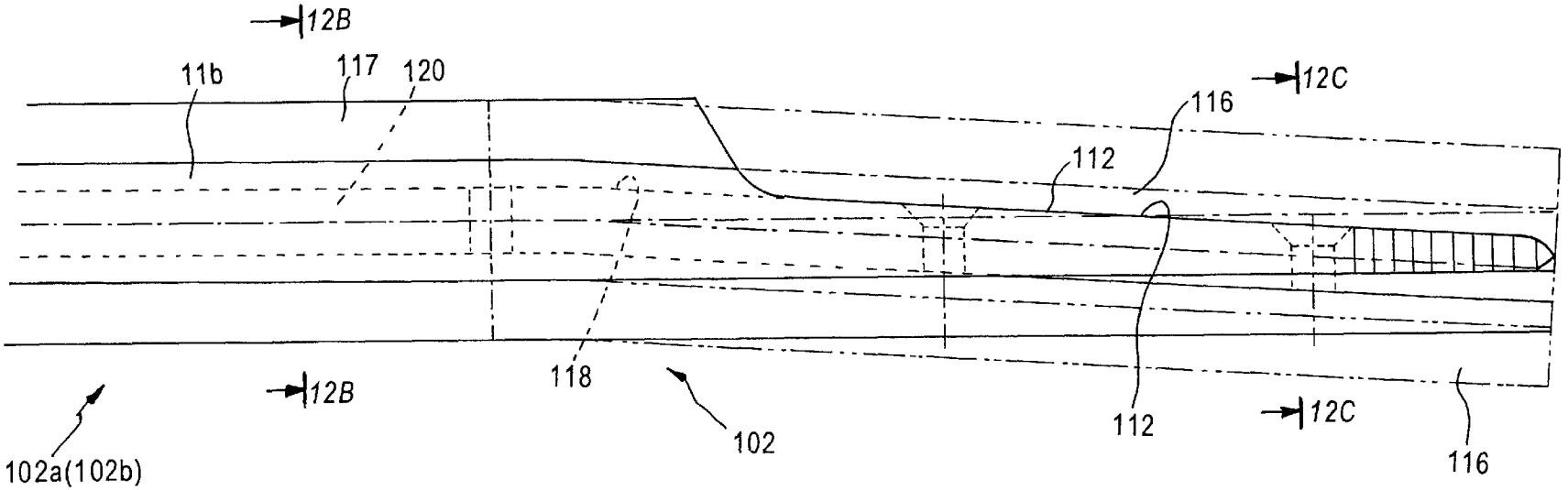
FIG. 12A is a top plan view scaled representation of an approach rail formed from thick web rail stock to depict the extent to which the rail end is bent and milled to form the miter rail point.
Figure 12B:
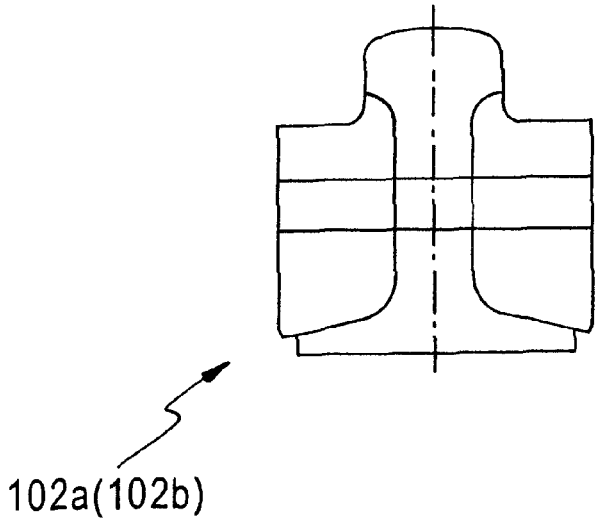
FIG. 12B is a sectional view scaled representation taken along the line 12B—12B of FIG. 12A to depict the cross-section of the thick web rail in areas outside of the point.
Figure 12C:
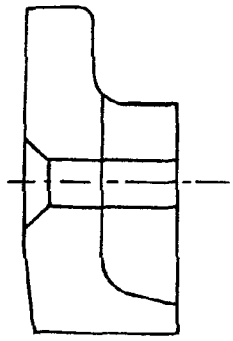
FIG. 12C is a sectional view scaled representation taken along the line 12C—21C to depict the side contour of the notched rail along the miter rail point.
Figure 13A:
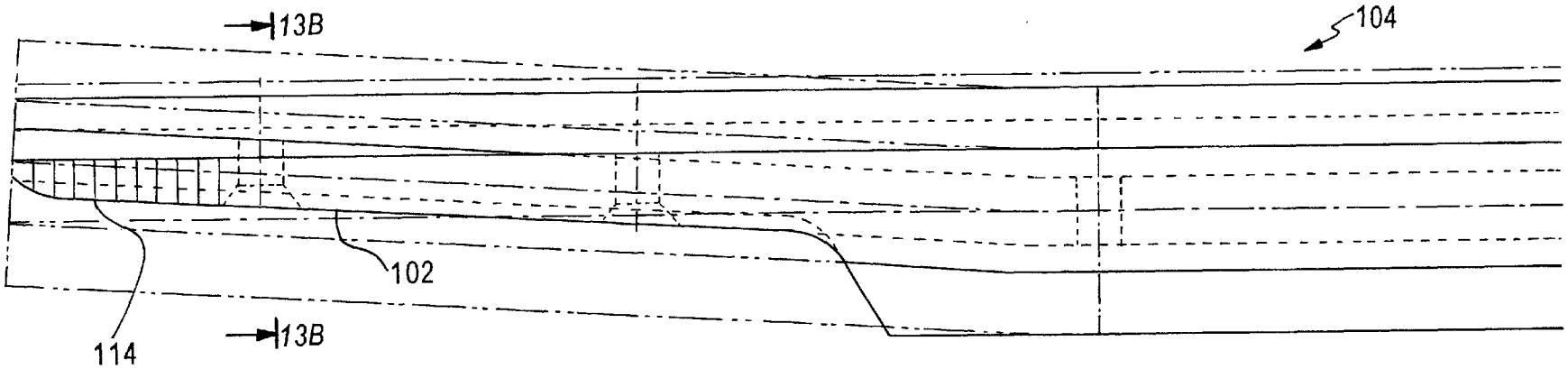
FIG. 13A is a view similar to FIG. 12A but of the lift rail.
Figure 13B:
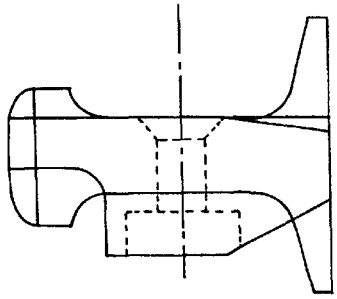
FIG. 13B is a sectional view scaled representation taken along the line 13B—13B of FIG. 13A.

The inwardly facing sides of adjacent ends of the fixed and lift rails 102*a*,104*a* and 102*b*,104*b* are bent and then machined (by milling) based upon the scaled illustrations depicted in FIGS. 12A—12C (fixed rails 102*a*,102*b*) and 13A—13B (lift rails 104*a*,104*b*), respectively, so that the resulting cross-sectional profiles are as depicted in FIG. 8 in which the right-hand section is the lift rail and the left-hand section is the approach rail. As can best be appreciated from either FIG. 12A or 13A, the notch 112,114 respectively formed in the associated rail ends of rails 102,104 along the inward facing side involves the removal of a section of the crown 116 (and base 117) along most of the bent rail section up to the inward facing side 118 of the thick web 120 as can be seen with reference to line 112 in FIG. 12A with respect to the approach rail section or line 114 with reference to FIG. 13A depicting the lift rail section.

As best depicted in FIG. 5, the lift and fixed rails are respectively attached to a series of appropriate left and right-handed rail base plates (BP1, BP2,BP3,BP4) by any suitable fastening means, such as shaped rail clips. The rail plates are also preferably provided with a plurality of throughbores adapted to receive spikes (not shown) or similar fasteners for securing the plate to underlying conventional railroad ties. Vibration dampers are also preferentially disclosed between the undersurfaces of the rail plates and the ties as known in the art. The railroad ties are, in turn, supported by one or the other of the fixed structure or the movable structure disposed on opposite sides of the miter rail joints 100. As mentioned above, the stationary structure may be a roadway, bridge pier, etc., while the movable structure may be a movable bridge deck associated with a vertical lift bridge, a bascule bridge, a swing bridge, etc. In the event that the movable structure is a swing bridge, opposite ends of the movable structure which are coextensive with the notched ends of the lift rails 104*a*,104*b*, would be rotated about a vertical rotational axis extending through the center of the movable bridge deck after the notched ends of the lift rails are pivoted about the horizontal pivot axis P so as to clear the notched ends of the approach or fixed rails 102*a*,102*b* to enable such rotary movement to occur. In this case, only the notched ends of the lift rails must be lifted. More particularly, the end of the lift rail must be raised to a height sufficient to clear the approach rail. Suitable lifting arrangements such as directly or indirectly driven mechanical, pneumatic, or hydraulic lift devices may be provided on the movable structure near the track joint to achieve the desired lifting of the lift rail. The lift rail is unattached to the lift rail base plates except at the pivot point P (which is at the end of the lift rail opposite the joint 100). However, because of the inherent flexibility and lengths of rail involved, the lift rail may be repeatedly lifted and lowered by the lifting device (approximately 6–11 inches of height) without experiencing significant fatigue.

Figure 7:
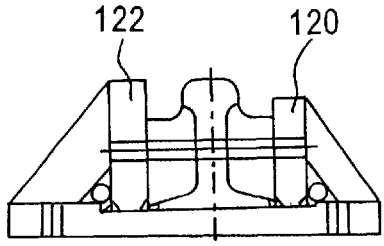
FIG. 7 is a sectional view scaled representation taken along the line 7—7 of FIG. 5 to depict the uncut or unmilled cross-sectional area of the thick web rail.

The fixed rail may be bolted to side bars 120 and guard rails 122 that are used to provide lateral support for the rail as best depicted in FIG. 7. As depicted in FIGS. 8–11, it can be seen that the side bars 124 and guard rails 126 cooperate with guide blocks to maintain the notches in appropriate alignment with each other.

In the installation shown in FIG. 5, the lift rail spans the track joint such that its notched end substantially matingly receives the notched end of the fixed rail projecting from the end of the fixed rail. Depending on the expected range of temperature under which the miter rail system 100 of the present invention is to be exposed, the tips of the fixed and lift rails should be disposed at a minimum gap of about 2–4 inches. Additional gaps should be maintained between the lift wheel and the supporting blocks to permit free passage of the lift rail under all temperatures likely to be experienced by the bridge.

Figure 14:
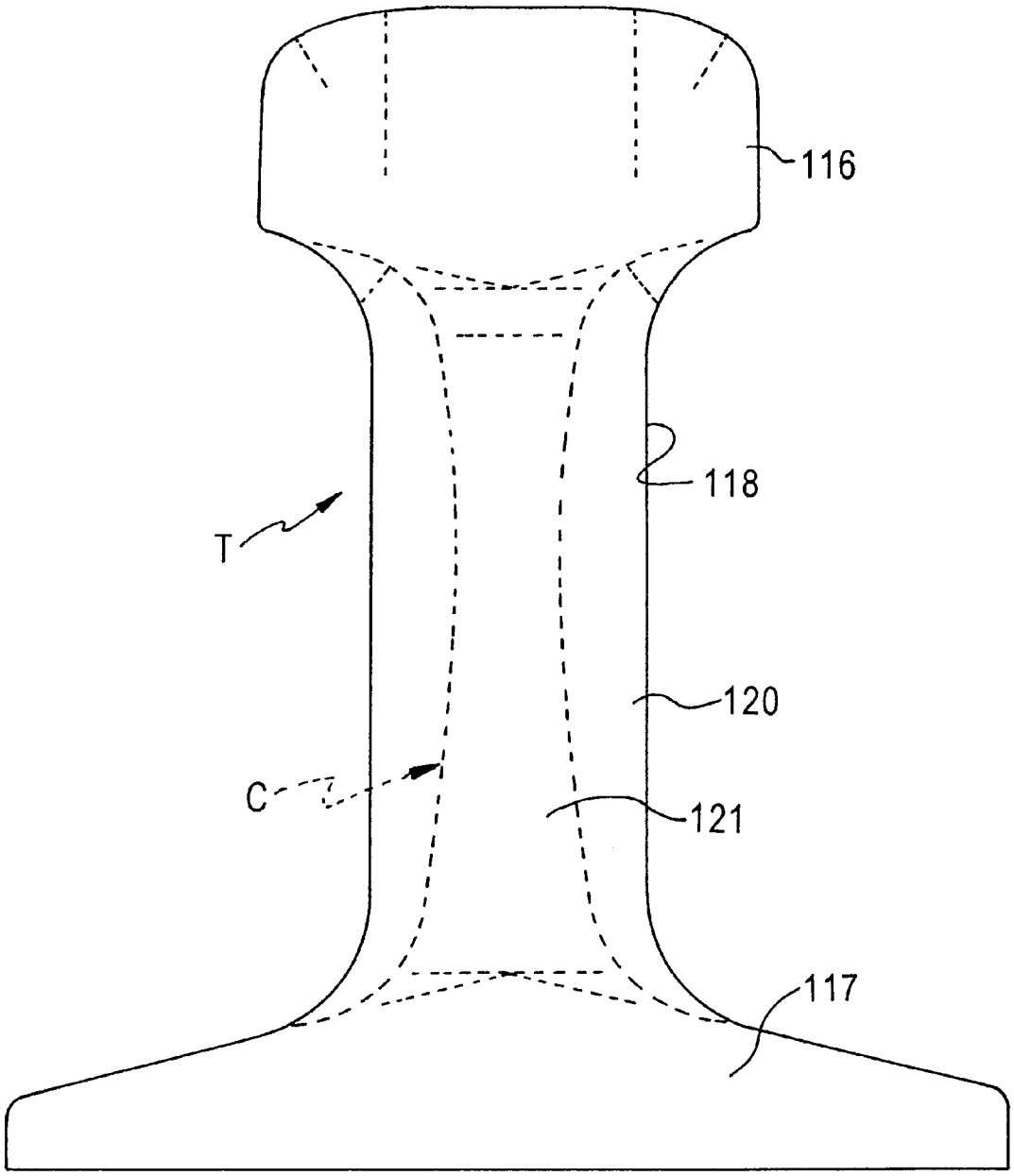
FIG. 14 is a cross-sectional view of the thick web rail stock used in accordance with the present invention overlaid with the cross-section of a conventional rail stock formed without the thick web, in a scaled representational view.

With reference to FIG. 8 again, it can be seen that, as a result of the thick web profile of the approach and lift rails forming the miter rail joint 100, there is a substantial amount of supporting web section 120 thickness remaining along the notched ends, particularly on the gage side of the rail, to provide good support for the rolling wheel stock as it traverses the joint. As best depicted in FIG. 14, the crown or head 116 and base 117 of the thick web rails T is substantially identical to the corresponding parts of conventional rail stock C formed with a more standard web thickness 121 of about ¾ inch. Both the thick web rail T and so-called thin web rail C are both made of rail steel. The thick web rail may be 132 pound stock or 136 pound stock or any other similar steel stock.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A miter rail system, comprising a fixed running rail and a lift running rail each made of a thick web material having a crown, a base and a web extending between the base and crown, each lift rail and fixed rail having facing ends that are each milled out to form a notch extending through at least the associated crown and base that enables the fixed and lift rail ends to interfit with each other along the extent of the notches with a gap therebetween so that at least gage sides of the respective rails are in alignment with each other to provide a generally smooth and uninterrupted surface for rolling stock, wherein the web extending between the base and crown is a uniform thickness along the length of the notch.

2. The miter rail system of claim 1, wherein each thick web has a web thickness of approximately 1¼–1¾ inch.

3. The miter rail system of claim 2, wherein each thick web rail is steel.

4. The miter rail system of claim 3, wherein each notch has a longitudinal extent of approximately 20 inches.

5. The miter rail system of claim 1, wherein distal ends of the notch are tapered.

6. The miter rail system of claim 1, wherein the web having a uniform thickness between the base and crown extends along greater than half the length of the notch.

7. A miter rail system, comprising a fixed rail and a lift rail each made of a thick web material having a crown, a base and a web extending between the base and crown, each lift rail and fixed rail having facing ends that are each milled out to form a notch extending through at least the associated crown and base that enables the fixed rail ends and lift rail ends to interfit with each other along the extent of the notches with a gap therebetween so that at least gage sides of the respective rails are in alignment with each other to provide a generally smooth and uninterrupted surface for rolling stock, wherein each notched rail end is a bent section of the associated thick web rail that is milled so that the notched surface, in over head plan view, is coextensive with the side of the web facing the notch.

8. The miter rail system of claim 7, wherein distal ends of the notch remote from the associated rail are convex in overhead plan view.

9. A method of manufacturing a miter rail system, comprising the steps of:

bending an end section of a thick web rail having a crown, base and web extending between the base and crown; and milling an end section of the thick web rail to form a notch in the crown and base along an inward facing side of the thick web rail, wherein the web extending between the base and crown is a uniform thickness along the length of the notch.

10. The method of claim 9, wherein the web having uniform thickness of between the base and crown extends along greater than half the length of the notch.

* * * * *

UNITED STATES PATENT AND TRADEMARK OFFICE

CERTIFICATE OF CORRECTION

PATENT NO. : 6,672,516 B1
DATED : January 6, 2004
INVENTOR(S) : Skoutelas

It is certified that error appears in the above-identified patent and that said Letters Patent is hereby corrected as shown below:

Title page,
Item [54], should read -- THICK WEB MITER RAIL TRACK JOINT SYSTEM BETWEEN STATIONARY AND VERTICALLY MOVABLE TRACK SECTIONS --.

Signed and Sealed this

Twenty-seventh Day of April, 2004

JON W. DUDAS
*Acting Director of the United States Patent and Trademark Office*